US005503123A

United States Patent [19]

Carter

[11] Patent Number: 5,503,123

[45] Date of Patent: Apr. 2, 1996

[54] INTERNAL COMBUSTION ENGINE CYLINDER PUPPET VALVE HAVING SELF-ALIGNING GUIDE

[75] Inventor: Robert W. Carter, Windsor, Canada

[73] Assignee: Ford Motor Company, Dearborn, Mich.

[21] Appl. No.: 431,942

[22] Filed: May 1, 1995

[51] Int. Cl.[6] ..... F01L 3/08

[52] U.S. Cl. ..... 123/188.6; 123/188.8; 123/188.9; 123/188.16; 251/85; 251/87; 251/323

[58] Field of Search ..... 123/188.2, 188.16, 123/188.6, 188.8, 188.9; 251/337, 323, 85, 87

[56] References Cited

U.S. PATENT DOCUMENTS

| | | | |
|---|---|---|---|
| 1,919,481 | 7/1933 | Moorhouse | 123/189.9 |
| 2,191,333 | 2/1940 | Willgoos . | |
| 2,397,502 | 4/1946 | Ralston . | |
| 2,658,491 | 11/1953 | Rostu . | |
| 2,689,557 | 9/1954 | Taylor . | |
| 2,694,391 | 11/1954 | Ohly . | |
| 2,716,401 | 8/1955 | Sietman . | |
| 2,778,352 | 1/1957 | Kimberly . | |
| 2,797,676 | 7/1957 | Van Skike . | |
| 2,807,253 | 9/1957 | Etchells | 123/188.9 |
| 3,265,052 | 8/1966 | Goloff . | |
| 3,577,729 | 5/1971 | Warren | 123/188.9 |
| 4,805,568 | 2/1989 | Springer et al. | 123/188.9 |
| 4,831,976 | 5/1989 | Pozniak et al. . | |
| 4,976,231 | 12/1990 | Feuling . | |
| 5,313,917 | 5/1994 | Santi . | |

FOREIGN PATENT DOCUMENTS

| | | |
|---|---|---|
| 1021793A | 8/1979 | U.S.S.R. . |

*Primary Examiner*—Erick R. Solis

*Attorney, Agent, or Firm*—Jerome R. Drouillard; Roger L. May

[57] ABSTRACT

A cylinder head assembly for an internal combustion engine includes self-aligning valve guides which are movable radially and coaxially to a variety of locations in which the axes of the valve guide and valve guide bore formed in the cylinder head are all parallel. The final location of the valve guide is determined by the contact relationship between the valve head and its mating valve seat.

8 Claims, 1 Drawing Sheet

INTERNAL COMBUSTION ENGINE CYLINDER PUPPET VALVE HAVING SELF-ALIGNING GUIDE

BACKGROUND OF THE INVENTION

1. Field of the Invention

The present invention relates to poppet valves for internal combustion engines. These valves are used for the purpose of allowing either air, or air and fuel into the engine cylinders (intake valves) and for allowing spent gases to be removed from the cylinders (exhaust valves).

2. Disclosure Information

Poppet valves are used as described above to govern the flow of gases into and out of engine cylinders; these valves must seal tightly for a variety of reasons. First, in the event that the exhaust valves do not seal tightly, e.g., if the valve's head is either not placed tightly in contact with the valve's seat, or if the seat or valve are burned or otherwise eroded, unburned hydrocarbon emissions from the engine may be excessive. Further, if exhaust valves do not seal tightly the valve may become burned, causing a loss of engine compression, performance, fuel economy, and increased emissions.

Intake valves must also be sealed tightly to avoid problems with loss of compression and resultant loss of efficiency and power output. The trend toward multi-valve engines has exacerbated the problem of achieving adequate valve sealing because smaller valve stems must be housed within increasingly smaller valve guides, and this causes difficult machining issues in production plants because very small valve guide bores must be machined at a rapid pace using very small tooling. U.S. Pat. No. 5,313,917 (Santi) attempts to address the problem of valve sealing by providing a self-aligning valve having a relatively large gap between the valve guide bore and the valve stem, which is combined with an exceedingly short bushing located only in the vicinity of the port. Unfortunately, it is believed that such an arrangement would not work well with a modern automotive engine, because the small bushing used to seal the valve stem would need to be compliant enough to allow misalignment of the valve but yet function as a seal, which would be very difficult and likely not occur properly. In contrast, according to the present invention the valve guide, as opposed to the merely the valve is self-aligning. As a result, a system according to the present invention provides the advantage that the valve will be allowed to seal properly with its mating seat while at the same time the valve is properly supported within a valve guide having conventional length and sealing capability, so as to preclude the excessive loss of lubricating oil through the valve guide. This is a potential problem with the system shown in the '917 patent.

Those skilled in the art will appreciate that the avoidance of lubricating oil consumption by automotive engines is desirable inasmuch as the combustion products of lubricating oil have been implicated in the poisoning of automotive exhaust aftertreatment catalysts. As a result, the system of the '917 patent would not be expected to perform properly for this additional reason. In contradistinction, a system according to the present invention will provide proper oil control while at the same time promoting proper sealing between the valve head and the valve guide. Other advantages of the present invention will become apparent to the reader of this specification.

SUMMARY OF THE INVENTION

A cylinder head assembly for an internal combustion engine includes a housing adapted to receive a plurality of intake and exhaust popper valves and having a plurality of intake and exhaust ports formed therein, and a plurality of popper valves mounted within the housing, with each valve having a head which is engageable with a valve seat located at the terminus of a port situated within the housing adjacent a combustion chamber. Each popper valve further has a stem adapted to be received within a valve guide. The valves are urged into engagement with the valve seats by means of springs, with each spring abutting a spring seat. Valve guide bores extend within the housing from the ports to the spring seats. Each valve stem passes through a self-aligning valve guide comprising a generally cylindrical body extending through the valve guide bore from a location inside the port to the spring seat and having a central bore for slidingly receiving the valve seem such that the valve stem is able to move with only reciprocating and rotational motion with respect to the guide, with the guide having a cylindrical outer surface with a diameter which is less than the diameter of the valve guide bore such that the valve and valve guide are movable radially and coaxially to a plurality of locations in which the axes of the valve, the valve guide, and the valve guide bore are parallel. The valve guide has a cylindrical outer surface which is preferably of constant diameter, and the valve guide and the entire valve, in fact, are movable radially and coaxially.

In an alternative embodiment, the valve guide has a spring seat formed integrally therewith, with the spring seat having a generally flat surface for engaging a valve spring and a convex surface for mating with a concave valve guide seat which is formed in the cylinder head's housing. The valve guide has a generally cylindrical outer surface with a diameter which is less than the diameter of the valve guide bore, such that the valve and the valve guide are allowed to move coaxially and rotationally as the convex surface of the valve guide slides with respect to the concave valve guide seat, with the result that the valve head is aligned with the valve seat. In essence, the final location of the valve guide is determined by the contact relationship between the valve head and its mating valve seat. Once the valve, the valve guide, and valve seat are installed in an engine, the valve guide will be locked in place in the valve guide bore by particulate material deposited by gases flowing through the port.

DETAILED DESCRIPTION OF THE PREFERRED EMBODIMENTS

Figure 1:
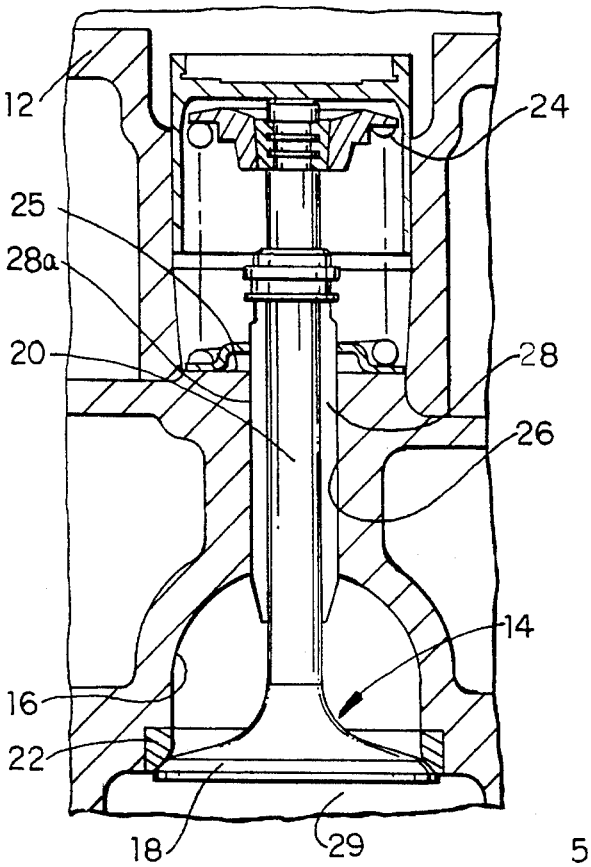
(PRIOR ART) FIG. 1
FIG. 1 shows certain prior art elements, including elements associated with the present invention.

FIG. 1 illustrates a prior art poppet valve and valve guide arrangement for an internal combustion engine which does not have self-aligning guides. A cylinder head according to the present invention has certain of the elements which are shown in FIG. 1, it being understood that the difference between the prior art and the present invention relates to the configuration, function, and capabilities of the valve guide to achieve alignment between the valve head and the valve seat.

Continuing now with FIG. 1, a cylinder head includes housing 12 having a plurality of intake and exhaust poppet valves 14 disposed therein. Each of valves 14 controls the flow through a single intake or exhaust port 16. Those skilled in the art will appreciate in view of this disclosure that a system according to the present invention could be employed with both the intake or exhaust valves of an engine, or only the exhaust valves or only the intake valves, if so desired.

Each of valves 14 has a stem 20 which is adapted to be received within valve guide 28. Each valve 14 also has valve head 18 which is engageable with valve seat 22. As shown in FIG. 1, valve seat 22 is located at the terminus of one of the intake or exhaust ports 16. Moreover, each valve seat 22 is adjacent to combustion chamber 29 which is formed in cylinder head housing 12.

Head 18 of valve 14 is urged into contact with seat 22 by means of a compression spring 24 which bears against spring seat 25. In the prior art embodiment shown in FIG. 1, valve guide 28 has an outer cylindrical surface 28*a* which is sized to have an interference fit with valve guide bore 26 which extends within housing 12 from port 16 to spring seat 25. As a result, valve guide 28 is not able to move at all with respect to valve guide bore 26. And, because the diameter of valve stem 20 is sized only slightly smaller than the inside diameter of the valve guide, valve 14 is only able to move with reciprocating motion as well as rotational motion about the axis of valve guide 28. In other words, valve 14 is not able to move laterally or radially with respect to valve guide 28 so as to accommodate any mislocation occurring between head 18 and seat 22 resulting from the stack-up of manufacturing tolerances. As a result, the system shown in FIG. 1 is prone to leakage occurring because of incidental radial tolerance mismatches.

Figure 2:
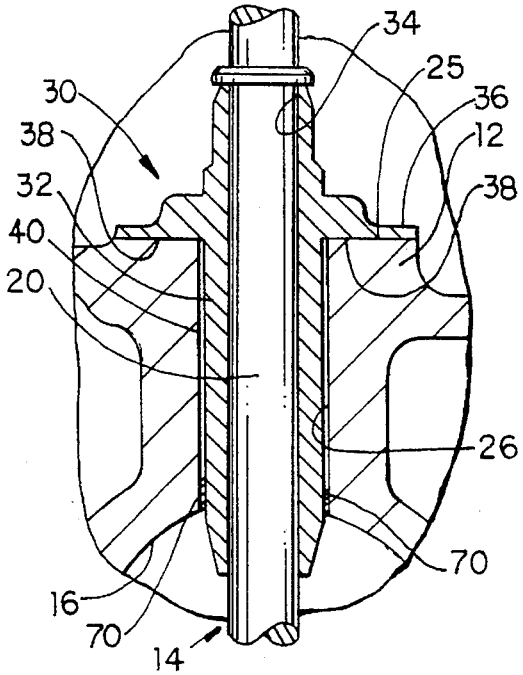
FIG. 2 illustrates a first embodiment of the present invention in which a valve guide and valve are movable radially and coaxially in directions which are parallel to the valve guide bore, with the magnitude of such movement being limited by predetermined clearances established between the valve guide and valve guide bore.

FIG. 2 illustrates a first embodiment according to the present invention in which self-aligning valve guide 30 has a generally cylindrical body 32 extending through valve guide bore 26, from a location inside port 16 to spring seat 25, and having central bore 34 for receiving valve stem 20 such that valve stem 20 is able to move with only reciprocating and rotational motion which is coaxial with the axis of central bore 34. Self-aligning valve guide 30 has cylindrical outer surface 40 with a diameter which is less than the inside diameter of valve guide bore 26, with the result that valve 14 and self-aligning valve guide 30 are movable radially and coaxially to a plurality of locations in which the axes of valve 14, valve guide 30, and valve guide bore 26 are parallel. This occurs because self-aligning valve guide 30 has rigid, integral spring seat abutment 36 interposed between spring 24 (not shown) and spring seat 25. As shown in FIG. 2, integral spring abutment 36 has a flat mating surface 38 which adjoins and abuts spring seat 25 so as to provide a mating surface allowing sliding engagement between self-aligning valve guide 30 and housing 12 such that valve 14 always remains parallel to the axis of valve guide bore 26. In this manner, the concentricity of valve head 18 and valve guide 22 may be maintained because during manufacturing of a cylinder head built according to the present invention, valve guide bore 26 is used in the machining of the pocket into which valve seat 22 is pressed, as well as in the finishing of valve seat 22. It has been determined that self-aligning valve guide 32 will perform satisfactorily with up to a 0.020 inch undersize fit to valve guide bore 26.

Figure 3:
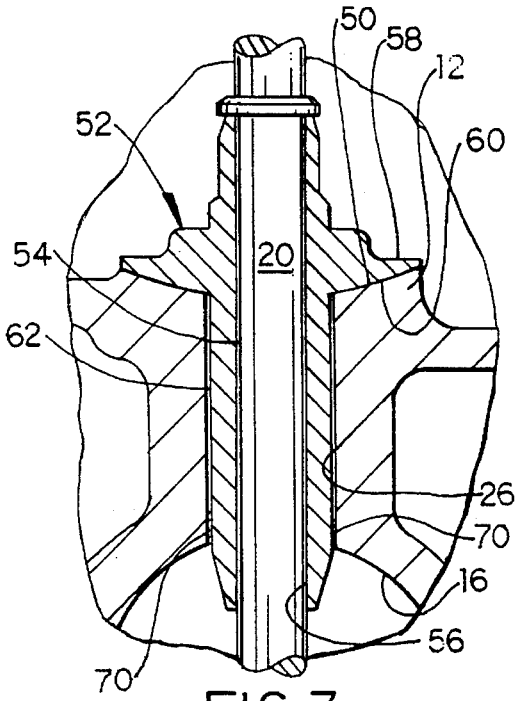
FIG. 3 illustrates a second embodiment of the present invention in which a valve and valve guide are able to rotate longitudinally with respect to a valve guide bore.

FIG. 3 illustrates an alternative embodiment according to the present invention in which self-aligning valve guide 52 has a generally cylindrical body 54 extending between combustion chamber 16 and a concave valve guide seat 50. Valve guide 52 has a mating convex surface 60, as well as a spring seat flat surface 58. Generally cylindrical outer surface 62 of self-aligning valve guide 52 has a diameter which is less than the diameter of valve guide bore 26, thereby allowing valve 14 having valve stem 20, and valve guide 52 to move coaxially and rotationally as convex surface 60 slides with respect to concave valve guide seat 50. In turn, this allows valve head 18 (not shown) to be aligned with valve seat 22 (not shown). Valve 14, which of course includes valve stem 20, and valve guide 52 move coaxially because central bore 56 of self-aligning guide 52 and valve stem 20 are sized so as to prevent valve 14 from moving radially with respect to self-aligning guide 52.

According to yet another aspect of the present invention, it is anticipated that the interstices between valve guide bores 26 and generally cylindrical outer surfaces 40, in the case of the embodiment of FIG. 2, and 62 in the case of the embodiment of FIG. 3, will eventually become occluded by particulate material deposited by gases flowing through port 16. In this manner, self-aligning valve guides 30 and 52 will become locked in place in their respective valve guide bores. This will fix the valve guides in place and prevent any further motion of valve guides and valves 14. This is desirable because it is not expected that the radial location of valve seats 22 will change after the manufacturing process has been completed. The particulate matter in the case of exhaust ports is expected to be raw exhaust gases containing carbonaceous material and other particulate materials arising from additives in lubricating oil and gasoline. In the case of intake ports, the self-aligning valve guides will become locked in place by particulate matter arising from exhaust gas recirculation (EGR) gases flowing through ports 16. Those skilled in the art will appreciate that gases circulating through intake manifolds in engines having EGR contain particulate matter which may cause deposits in some cases, and in this case, beneficially.

Figure 4:
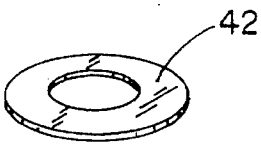
FIG. 4 illustrates a sealing washer.

With certain engines and valve arrangements, it may be desirable to use interpose anerobic sealing compound between the valve guide bore and the outer cylindrical surface of the valve guide. Such sealers may be drawn from the class of engine sealing compounds known to those skilled in the art of engine sealing systems. Also, with yet other engines and valve arrangements it may be desirable to interpose sealing washer 42, as shown in FIG. 4, between the valve guide and the cylinder head housing's mating surface. Such a washer could be made of polytetrafluoroethylene or other types of non-metallic or metalliic compounds which would seal the interface between the valve guide and cylinder head housing, while having sufficient lubricity so as to allow the valve guide and valve to become aligned with the valve seat at the time the engine is first put into operation.

While the invention has been shown and described in its preferred embodiments, it will be clear to those skilled in the arts to which it pertains that many changes and modifications may be made thereto without departing from the scope of the invention.

I claim:

1. A cylinder head assembly for an internal combustion engine, comprising:

a housing adapted to receive a plurality of intake and exhaust poppet valves and having a plurality of intake and exhaust ports formed therein;

a valve seat located at the terminus of one of said ports and adjacent a combustion chamber formed in said housing;

a plurality of popper valves mounted within the housing and, with each valve having a valve head which is engageable with the valve seat so as to control the flow of gases through the port, and a stem adapted to be received within a valve guide;

a spring for urging said valve into engagement with said valve seat, with said spring abutting a spring seat;

a valve guide bore extending within the housing from the port to said spring seat; and a self-aligning valve guide comprising a generally cylindrical body extending through said valve guide bore from a location inside said port to said spring seat and having a central bore for slidingly receiving said valve stem such that the valve stem is able to move with only reciprocating and rotational motion with respect to the guide, and with the guide having a cylindrical outer surface with a diameter which is less than the diameter of the valve guide bore and a mating surface in contact with the spring seat such that the valve and valve guide are moveable radially and coaxially to a plurality of locations in which the axes of the valve, the valve guide, and the valve guide bore are parallel, such that the final location of the valve guide is determined by the contact relationship between the valve head and its mating valve seat.

2. A cylinder head assembly according to claim 1, wherein said cylindrical outer surface of said guide has a constant diameter.

3. A cylinder head assembly according to claim 1, wherein the valve guide and the entire valve are moveable radially and coaxially.

4. A cylinder head assembly according to claim 1, wherein said valve guide has a rigid, integral spring abutment interposed between said spring and said spring seat, with said spring abutment having a flat surface which adjoins and abuts the spring seat so as to accommodate radially directed sliding motion between the valve guide and the cylinder head housing.

5. A cylinder head assembly according to claim 4, further comprising a sealing washer interposed between the flat surface of the spring abutment and the spring seat.

6. A cylinder head assembly according to claim 4, further comprising sealing material interposed between the outer cylindrical surface of the valve guide and the inner surface of the valve guide bore.

7. A cylinder head assembly according to claim 1, wherein said valve guide extends into an exhaust port and is locked in place by particulate matter from exhaust gases flowing through the port.

8. A cylinder head assembly according to claim 1, wherein said valve guide extends into an intake port and is locked in place by particulate matter from EGR gases flowing through the port.

* * * * *